United States Patent [19]

Budzich

[11] 4,436,115

[45] Mar. 13, 1984

[54] PRESSURE COMPENSATED FLUID CONTROL VALVE WITH MAXIMUM FLOW ADJUSTMENT

[75] Inventor: Tadeusz Budzich, Moreland Hills, Ohio

[73] Assignee: Caterpillar Tractor Company, Peoria, Ill.

[21] Appl. No.: 357,037

[22] Filed: Mar. 11, 1982

[51] Int. Cl.[3] ..... F15B 13/04

[52] U.S. Cl. ..... 137/596.1; 91/421; 91/446; 137/596.13

[58] Field of Search ..... 137/596.13, 596.1; 91/421, 446

[56] References Cited

U.S. PATENT DOCUMENTS

| | | | |
|---|---|---|---|
| Re. 29,538 | 2/1978 | Budzich | 137/596.1 X |
| 4,327,627 | 5/1982 | Budzich | 137/596.13 X |
| 4,333,389 | 6/1982 | Budzich | 137/596.1 X |
| 4,362,087 | 12/1982 | Budzich | 91/446 X |

*Primary Examiner*—Gerald A. Michalsky

*Attorney, Agent, or Firm*—Sixbey, Friedman & Leedom

[57] ABSTRACT

A direction flow control valve responsive to a manual control signal for control of positive and negative loads operated by a single pilot valve stage, which automatically maintains a relatively constant pressure differential across valve spool, while controlling positive and negative loads and which permits independent adjustment in maximum flow level through the valve for positive and negative load control.

9 Claims, 1 Drawing Figure

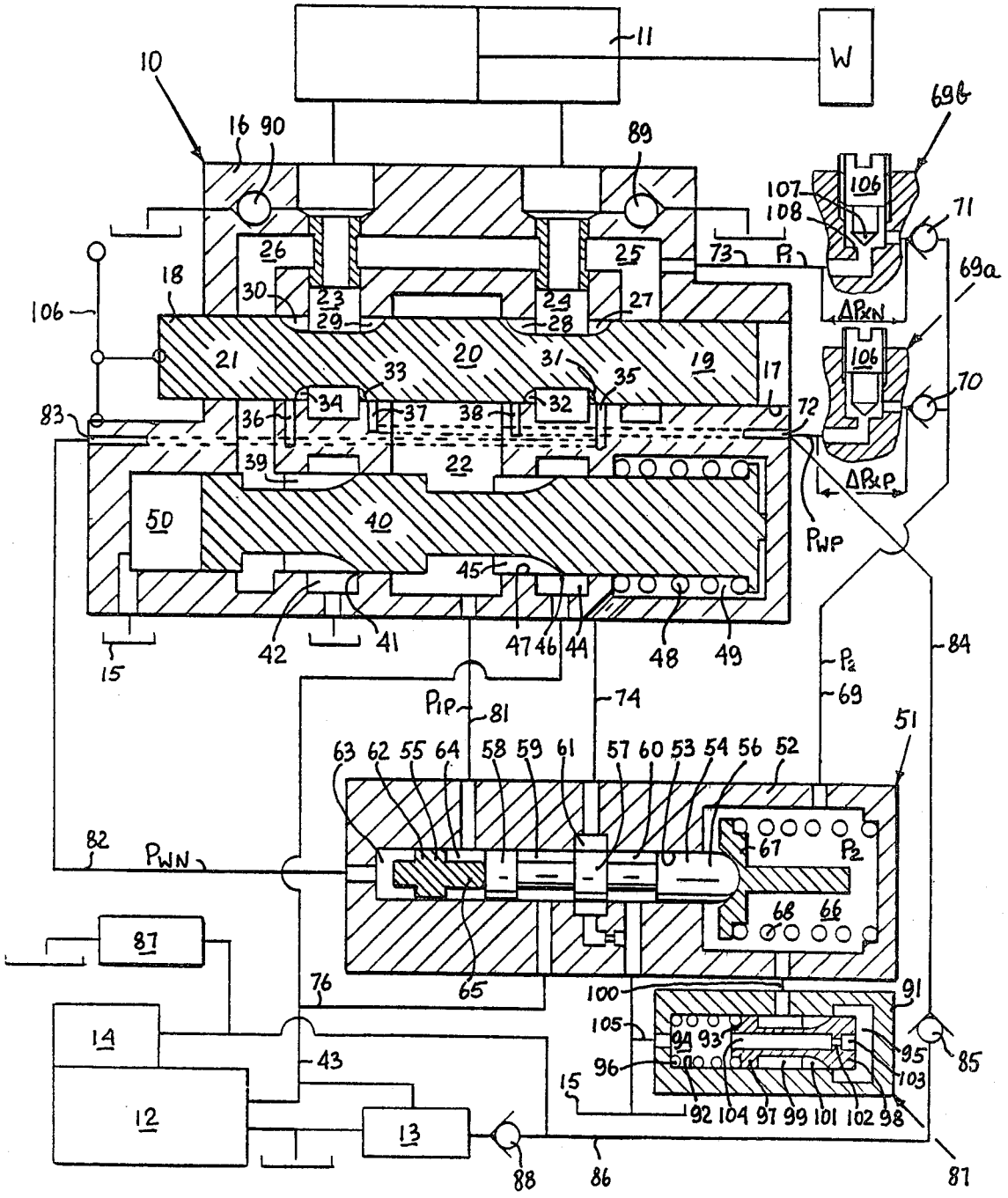
W
10
11
16
90
89
69b
106
107
108
71
73
P1
69a
18
26
25
30
23
24
27
29
28
ΔPxN
21
20
31
19
33
35
17
34
32
70
83
36
37
38
72
39
22
ΔPxP
50
40
PWP
45
42
41
47
46
44
48
49
15
84
P2
69
PIP
81
74
51
63
62
55
64
58
59
61
57
60
53
54
56
52
82
PWN
67
P2
68
66
87
65
76
100
91
14
105
94
93
95
85
43
96
103
15
12
13
92
104
97
99
101
102
98
88
86
87

PRESSURE COMPENSATED FLUID CONTROL VALVE WITH MAXIMUM FLOW ADJUSTMENT

BACKGROUND OF THE INVENTION

This invention relates generally to fluid control valves provided with positive and negative load compensation.

In more particular aspects this invention relates to pressure compensated direction and flow control valves, and positive and negative load compensators of which are controlled by a single amplifying pilot valve stage.

In still more particular aspects this invention relates to pilot operated pressure compensated controls of direction control valves, used in control of positive and negative load, which permit variation in the level of control differential across metering orifices of the valve spool, while this control differential is automatically maintained constant at each controlled level.

In still more particular aspects this invention relates to pilot operated pressure compensated controls of direction control valves which permit an independent adjustment in the maximum flow level through the valve for positive and negative load control.

Closed center fluid control valves, pressure compensated for control of positive and negative loads, are desirable for a number of reasons. They permit load control with reduced power losses and therefore, increased system efficiency. They also permit simultaneous proportional control of multiple positive and negative loads. Such fluid control valves are shown in my U.S. Pat. No. 4,180,098, issued Dec. 5, 1979 and also in my U.S. Pat. No. 4,222,409 issued Sept. 16, 1980. However, the valves of those patents although capable of proportional control of positive and negative loads, use for such control the energy directly transmitted through the load pressure sensing ports, which not only attenuate the control signals, but limit the response of the control. Those valves also automatically maintain a constant pressure differential across metering orifices in control of both positive and negative loads and do not limit maximum flow through the valve to any specific preselected level.

SUMMARY OF THE INVENTION

It is therefore a principal object of this invention to provide an improved pressure compensated valve, equipped for positive and negative load compensation, in which the positive and negative load compensator is controlled by a single amplifying pilot valve stage, which permits independent variation, while controlling positive or negative loads, in the level of control differential across metering orifices of the valve spool, while this control differential is automatically maintained constant at each controlled level.

Another object of this invention is to provide pilot operated pressure compensated controls of a direction control valve through which control of system positive or negative load can be either accomplished by variation in areas of the orifices between the valve controls and the fluid motor in response to a manual input, while the pressure differential across those orifices is maintained constant at a specific level, or by control of positive load pressure differential, acting across those orifices in response to first type control input, or by control of negative load pressure differential, acting across those orifices in response to second type control input, while the area of those orifices remains constant.

It is a further object of this invention to provide pilot operated pressure compensated controls of a direction control valve adapted to control of both positive and negative loads, which permit an independent adjustment in the maximum flow level through the valve for positive and negative load control.

Briefly the foregoing and other additional objects and advantages of this invention are accomplished by providing novel pressure compensated controls of a direction control valve, which permit selection of the level of maximum flow through the valve, at any desired value, for positive and negative load control. Each of those maximum flow levels, which can be different for positive and negative loads, corresponds to a specific control pressure differential, which is automatically maintained constant throughout the entire range of operation of the valve.

Additional objects of this invention will become apparent when referring to the preferred embodiment of the invention as shown in the accompanying drawing and described in the following detailed description.

DESCRIPTION OF THE DRAWING

The single FIGURE is a sectional view of an embodiment of a flow control valve provided with a single positive and negative load compensator, also showing a longitudinal sectional view of an embodiment of a pilot valve amplifying stage controlling the compensator and two fragmentary sectional views of a control signal modifying controls with fluid motor, system pump and other system valve shown schematically.

DESCRIPTION OF THE PREFERRED EMBODIMENT

Referring now to the drawing, an embodiment of a flow control valve, generally designated as 10, is shown interposed between diagrammatically shown fluid motor 11 driving load W and a pump 12, of a fixed displacement or variable displacement type, driven by a prime mover, not shown. Fluid flow from the pump 12 to flow control valve 10 and a circuit of diagrammatically shown flow control valve 13 is regulated by pump flow control 14. If pump 12 is of a fixed displacement type, pump flow control 14 is a differential pressure relief valve, which, in a well known manner, by bypassing fluid from pump 12 to a reservoir 15, maintains discharge pressure of pump 12 at a level, higher by a constant pressure differential, than load pressure developed in fluid motor 11. If pump 12 is of a variable displacement type, pump flow control 14 is a differential pressure compensator, well known in the art, which by changing displacement of pump 12, maintains discharge pressure of pump 12 at a level, higher by a constant pressure differential, than load pressure developed in fluid motor 11.

The pump flow control 14 may also be a maximum pressure compensator or relief valve, which maintains the discharge pressure of the pump 12 at a maximum constant pressure level during operation of the system.

The flow control valve 10 is of a four way type and has a housing 16 provided with a bore 17, axially guiding a valve spool 18. The valve spool 18 is equipped with lands 19, 20 and 21, which in neutral position of the valve spool 18, as shown in the drawing, isolate a fluid supply chamber 22, load chambers 23 and 24 and outlet chambers 25 and 26. Lands 19, 20 and 21, of valve spool 18, are provided with metering slots 27, 28, 29 and 30 and signal slots 31, 32, 33 and 34. Negative load sensing ports 35 and 36 are positioned between load chambers 23 and 24 and outlet chambers 26 and 25. Positive load sensing ports 37 and 38 are located between supply chamber 22 and load chambers 23 and 24. Negative load throttling slots 39, of control spool 40, equipped with throttling edges 41, connect outlet chambers 26 and 25 with an exhaust chamber 42, which in turn is connected reservoir 15.

The pump 12, through its discharge line 43, is connected to an inlet chamber 44. The inlet chamber 44 is connected through positive load throttling slots 45, on control spool 40, provided with throttling edges 46, with the fluid supply chamber 22. Bore 47 axially guides the control spool 40, which is biased by control spring 48, contained in control space 49, towards position as shown. The control spool 40 at one end projects into control space 49, the other end projecting into chamber 50, connected to the reservoir 15. A pilot valve assembly, generally designated as 51, comprises a housing 52, provided with a bore 53, slidably guiding pilot valve spool 54 and free floating piston 55. The pilot valve spool 54 is provided with lands 56, 57 and 58, defining annular spaces 59 and 60. Annular space 61 is provided within the housing 52 and communicates directly with bore 53. The free floating piston 55 is provided with a land 62, which defines annular spaces 63 and 64 and is provided with extension 65, selectively engageable with land 58 of the pilot valve spool 54. The pilot valve spool 54 at one end projects into control space 66 and engages, with its land 56 and spring retainer 67, a pilot valve spring 68. Control space 66 communicates directly through line 69 with check valves 70 and 71. The check valve 70 is connected by positive load signal control 69*a* and passage 72 with positive load sensing ports 37 and 38. The check valve 71 is connected by negative load signal control 69*b* and line 73 with the outlet chamber 25. Annular space 61, of the pilot valve assembly 51, communicates through line 74 with control space 49 and also communicates through leakage orifice, with annular space 60, which in turn is connected to reservoir 15. Annular space 59 communicates through line 76 with discharge line 43. Annular space 64 is connected by line 81 with the supply chamber 22. Annular space 63 is connected by line 82 and passage 83 with negative load sensing ports 36 and 35. Positive load sensing ports 37 and 38 are connected through passage 72, line 84 and a check valve 85 and a signal line 86 with the pump flow control 14. Control space 66 is connected through a flow control, generally designated as 87, with the reservoir 15. Flow control 87 is a flow control device, passing a constant flow from control space 66 to the reservoir 15. The load chambers 23 and 24 are connected, for one way fluid flow, by check valves 89 and 90, to schematically shown system reservoir, which also might be a pressurized exhaust manifold of the entire control system, as shown in the drawing. The flow control, generally designated as 87, is interposed between control space 66 and the system reservoir 15 and comprises a housing 91, provided with a bore 92, guiding a flow control spool 93, which defines spaces 94 and 95 and which is biased by a spring 96. The flow control spool 93 is provided with lands 97 and 98, defining annular space 99, which is connected by line 100 with control space 66. The flow control spool 93 is also provided with throttling slots 101 and leakage orifice 102, which communicates through passages 103 and 104, space 95, with space 94, space 94 being connected by line 105 with system reservoir 15. The negative load signal control 69*b* is interposed between the outlet chamber 25 and the check valve 71 and is provided with adjusting screw 106, equipped with a conical seat 107, which varies the area of flow orifice in respect to seat 108. The positive load signal control 69*a*, identical to the negative load signal control 69*b*, is positioned between port 72 and the check valve 70.

The preferable sequencing of lands and slots of valve spool 18 is such, that when displaced in either direction from its neutral position, as shown in the drawing, one of the load chambers 23 or 24 is connected by signal slot 32 or 33 to the positive load sensing port 37 or 38, while the other load chamber is simultaneously connected by signal slot 31 or 34 with negative load sensing port 35 or 36, the load chamber 23 or 24 still being isolated from the supply chamber 22 and outlet chambers 25 and 26. Further displacement of valve spool 18 from its neutral position connects load chamber 23 or 24 through metering slot 28 or 29 with the supply chamber 22, while simultaneously connecting the other load chamber through metering slot 27 or 30 with outlet chamber 25 or 26.

As previously described the pump flow control 14, in a well known manner, will regulate fluid flow, delivered from pump 12, to discharge line 43, to maintain the pressure in discharge line 43 higher, by a constant pressure differential, than the highest load pressure signal transmitted through the check valve system to signal line 86. Therefore, with the valve spool 18, of flow control valve 10, in its neutral position blocking positive load sensing ports 37 and 38, signal pressure input to pump flow control 14 from signal line 86 will be at minimum pressure level, corresponding with the minimum standby pressure of the pump 12.

As shown in the drawing, the flow control valve 10 is interposed between a schematically shown pump 12 and the fluid motor 11. The pilot valve assembly 51, in a manner as will be described later in the text, regulates the position of the control spool 40 to control the pressure differential $\Delta Pyp$ developed across orifices created by displacement of metering slots 28 and 29 and to control the pressure differential $\Delta Py$, across orifices created by displacement of metering slots 27 and 30. Control space 66 of the pilot valve assembly 51 is connected to the system reservoir 15 by the flow control, generally designated as 87, which is a constant flow device, passing a constant flow of fluid from control space 66 to the reservoir 15, irrespective of the magnitude of control pressure P2, in a manner as will be described later in the text. This constant flow of fluid passes either through the positive load signal control 69*a* or the negative load signal control 69*b*, which are interposed between the control pressure sensing circuit of flow control valve 10 and control space 66 of the pilot valve assembly 51. In a well known manner, for each specific position of adjusting screws 106 a constant pressure differential, equal to $\Delta PxP$ or $\Delta PxN$ will be developed across the positive load signal control 69*a* or the negative load signal control 69*b*. It is assumed, when describing the operation of the flow control valve of this invention, that with the adjusting screws 106 positioned all the way up, the pressure differentials $\Delta PxP$ and $\Delta PxN$ become so small that the value of control pressure P2 approaches the value of Pwp or P1 pressure.

Assume that the valve spool 18 is displaced by the manual lever 106 from left to right by sufficient amount to connect with signal slot 33 the load chamber 23 with positive load sensing port 37, while the load chamber 23 is still isolated from the supply chamber 22. Assume also that the load chamber 23 is subjected to a positive load pressure Pwp. The load pressure Pwp transmitted to passage 72 and the positive load signal control 69*a* will open the check valve 70, close the check valve 71 and will be transmitted through line 69 to the control space 66. Assume that due to full upward displacement of the adjusting screw 106 the pressure drop ΔPxp becomes negligible. The load pressure Pwp will be then directly transmitted to control space 66 with P2 becoming Pwp pressure. Control space 66 is connected through the flow control section 87 with the system reservoir 15. In a well known manner, the flow control spool 93 will automatically assume a throttling position, throttling the fluid from control space 66 at Pwp or P2 pressure, by action of throttling slots 101, to a pressure, equivalent to the preload of spring 96. Therefore space 95 will be always maintained at a constant pressure as dictated by the preload in the spring 96. Space 95 is connected through passage 103, leakage orifice 102 and passage 104 with space 94, connected to system reservoir 15 by line 105. Therefore, with constant pressure differential automatically maintained across leakage orifice 102, a constant flow, at a certain preselected minimum level, will take place from space 95 and control space 66, irrespective of the level of Pwp or P2 pressure. With the adjusting screw 106 in a fully open position, equivalent to minimum resistance to flow, P2 pressure will always equal Pwp pressure. The pilot valve spool 54 is subjected to Pwp pressure in the control space 66, preload of the pilot valve spring 68 and pressure P1p in annular space 64, which is connected by line 81 to the supply chamber 22, which in turn is connected, through throttling slots 45, with the inlet chamber 44, connected by discharge line 43 to the pump 12. Under the action of those forces the pilot spool 54 will move into a modulating position, as shown in the drawing, regulating the pressure in the control space 49 and therefore position of the control spool 40, throttling by throttling edges 46 the fluid flow from the inlet chamber 44 to the supply chamber 22, to maintain a constant pressure differential between annular space 64 and control space 66, equivalent to preload of the pilot valve spring 68. The free floating piston 55, subjected to pressure differential between annular spaces 64 and 63, will move all the way to the left out of contact with the pilot spool 54. Since the supply chamber 22 is closed by position of the valve spool 18 from the load chamber 23 the control spool 40 will assume a position, in which throttling edges 46 will completely isolate the inlet chamber 44 from the supply chamber 22.

Assume that the valve spool 18 is further displaced by the manual lever 106 from left to right, creating a metering orifice of specific area between the supply chamber 22 and the load chamber 23 through metering slot 29. Assume also that load chamber 23 is subjected to a positive load pressure Pwp. Fluid flow will take place from the supply chamber 22, through created metering orifice, to the fluid motor 11, the pilot valve assembly automatically throttling, through the position of the control spool 40, the fluid flow from the inlet chamber 44 to the supply chamber 22, to maintain across created metering orifice a constant pressure differential of ΔPyp equal to ΔP, which in turn is equal to the quotient of the preload of the pilot valve spring 68 and the cross-sectional area of the pilot valve spool 54. Since a constant pressure differential is maintained across created metering orifice a constant flow of fluid will be supplied to fluid motor 11, irrespective of the variation in the magnitude of the load W. Therefore under those conditions the flow to the fluid motor 11 becomes directly proportional to the flow area of the created metering orifice and independent of Pwp pressure.

Assume that while controlling a positive load W, in a manner as described above, the adjusting screw 106 of the positive load signal control was moved downward into position, as shown in the drawing, creating a resistance to constant flow. Assume also that due to that resistance a pressure differential ΔPxp is developed across the positive load signal control 66*a*. Then the control space 66 will be subjected to P2 pressure which is equal to the difference between Pwp pressure and ΔPxp. It can be seen that ΔPyp=P1p−Pwp, which is the pressure differential through created metering orifice, P1p−P2=ΔP, which is the constant pressure differential caused by the preload of the pilot valve spring 68 and that Pwp−P2=ΔPxp. From the above three equations when substituting and eliminating P1p, Pwp and P2 pressures, the basic relationship of ΔPyp=ΔP−ΔPxp is obtained. With ΔPxp=0, which is the case, as explained above, when the adjusting screw 106 is in its fully open position, ΔPyp=ΔP and the flow through the created metering orifice to the fluid motor is controlled at maximum constant pressure differential. Any value of ΔPxp, as can be seen from the basic equation, will automatically lower, by the same amount, ΔPyp, acting across created metering orifice, automatically reducing the quantity of fluid flow to the fluid motor 11, this flow still being maintained constant at a constant level and independent of the variation in the magnitude of load W. Therefore, by controlling the value of ΔPxp by the adjustment of adjusting screw 106, the pressure differential ΔPyp is controlled, controlling the velocity of load W. Therefore with valve spool 18 displaced all the way in either direction and with maximum area of flow of the control orifice created by displacement of metering slot 28 or 29, by adjustment of the positive load signal control 69*a*, the maximum flow of fluid through the flow control valve 10, during control of positive load, can be selected at any desired level. The resulting control pressure differential ΔPyp will then automatically be maintained constant, at the selected value, throughout the entire control range of the valve, as long as a positive load is being controlled.

Assume that the valve spool 18 is displaced by the manual lever 106 from left to right by a sufficient amount to connect with signal slot 31 the load chamber 24 with negative load sensing port 35, while the load chamber 24 is still isolated from the outlet chamber 25. Assume also that the load chamber 24 is subjected to a negative load pressure PwN. Then the pressure signal at PwN pressure will be transmitted through passage 83 and line 82 to annular space 63 and react on the cross-sectional area of the free floating piston 55. Assume also that with communication between the load chamber 24 and the outlet chamber 25 closed no pressure signal is transmitted through line 73 and that control space 66 is subjected to reservoir pressure, by the action of the flow control section 87. The pilot valve spool 54 will be displaced by the free floating piston 55 all the way to the right, connecting annular space 61 and the control space 49 with annular space 59, subjected to pump discharge pressure through line 76. The control spool 40 will automatically move all the way from right to left, with throttling edges 41 cutting off communication between the exhaust chamber 42 and the outlet chamber 26 and therefore isolating outlet chambers 25 and 26 from the system reservoir 15.

Assume that the valve spool 18 is further displaced by the manual lever 106 from left to right, creating a metering orifice of specific area between the load chamber 24 and the outlet chamber 25, subjected to negative load pressure PwN. Assume also that due to the full upward displacement of the adjusting screw 106 the pressure drop ΔPxN, induced by the regulated flow through the flow control 87, will be negligible. With the control spool 40 blocking the outlet chamber 26 from the exhaust chamber 42, the negative load pressure will be automatically transmitted through line 73 and the negative load signal control **69*b*, will open the check valve 71, close the check valve 70 and will be transmitted through line 69 to the control space 66. The P1 pressure in control space 66 will react on the cross-sectional area of pilot valve spool 54, the pilot valve spring 68 bringing it into its modulating position, as shown in the drawing and controlling the pressure in the control space 49, to establish a throttling position of the control spool 40, which will maintain a constant pressure differential across created metering orifice, as dictated by the preload of the pilot valve spring 68. Then PwN−P2 will equal constant ΔP, which is equal to the quotient of the preload of the pilot valve spring 68 and the cross-sectional area of the pilot spool 54. Since a constant pressure differential of ΔPyN=ΔP is maintained across the created metering orifice, flow out of the fluid motor 11 will be proportional to the area of the created metering orifice and independent of the magnitude of the negative load W. Therefore in this way, by varying the flow area of the metering orifice created by displacement of the valve spool 18**, the velocity of the load W can be controlled, each area of orifice representing a specific constant flow level, independent of the magnitude of the load W.

Assume that while controlling a negative load W, in a manner as described above, the adjusting screw 106 of the negative load signal control **69*b*, was moved back into position as shown in the drawing, creating a resistance to constant flow by reduction in flow area of the negative load signal control 69*b*. Assume also that due to that resistance a pressure differential ΔPxN is developed across the negative load signal control 69*b*, resulting in ΔPxN drop in P1 pressure. Therefore, P1−P2=ΔPxN, PwN−P2=ΔP and PwN−P1=ΔPyN. When substituting and eliminating P1 and P2 and PwN pressures, the basic relationship of ΔPyN=ΔP−ΔPxN can be established. With ΔPxN=0, which is the case with the negative load signal control 69*b* in its fully open position, as already described above, ΔPyN assumes its maximum constant value equal to ΔP. With the adjusting screw 106 in its throttling position, by controlling the value of ΔPxN the value of ΔPyN can be controlled from maximum to zero, each constant value of ΔPyN, at any specific flow area of metering orifice created by displacement of the valve spool 18, representing a specific constant flow at a specific level from the fluid motor 11 and independent of the magnitude of the negative load W. Therefore with valve spool 18 displaced all the way in either direction and with maximum area of flow of the control orifice created by displacement of metering slot 27 or 30, by adjustment of the negative load signal control 69*b* the maximum flow of fluid through the flow control valve 10**, during control of negative load, can be selected at any desired level. The resulting control pressure differential ΔPyN will than automatically be maintained constant at the selected value throughout the entire control range of the valve, as long as a negative load is being controlled.

By adjustment in the throttling characteristics of the positive and negative load signal controls **69*a* and 69*b* the maximum flow levels through the control valve 10** can be selected during positive and negative load control mode of operation. Those maximum flow values, for positive and negative load control, can be the same or can be selected at any desired different levels, each of those levels being automatically maintained constant throughout the entire range of control of the valve.

During control of positive load the free floating piston 55 is forceably maintained by a pressure differential out of contact with the pilot valve spool 54. During control of negative load the free floating piston 55 acts together with the pilot spool 54. During control of positive load the pressure differential across the orifice created by displacement of the valve spool 18, is controlled by the throttling action of positive load throttling slots 45. During control of negative load the pressure differential across the orifice created by displacement of the valve spool 18, is maintained by the throttling action of the negative load throttling slots 39. For control of positive load the pressure differential, acting across control orifice, together with the maximum flow through the control valve, can be selected by adjustment of the positive load signal control **69*a*. For control of negative load the pressure differential, acting across control orifice, together with the maximum flow through the control valve, can be selected by adjustment of the negative load signal control 69*b***.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A control valve assembly supplied with pressure fluid by a pump, said control valve assembly comprising a housing having an inlet chamber, a supply chamber, first and second load chambers, and exhaust means connected to reservoir means, first valve means for selectively interconnecting said load chambers with said supply chamber and said exhaust means, first positive load control orifice means responsive to movement of said first valve means and operable to meter fluid flow between said supply chamber and said load chambers, second negative load control orifice means responsive to movement of said first valve means and operable to meter fluid flow between said load chambers and said exhaust means, positive load fluid throttling means between said inlet chamber and said supply chamber, negative load fluid throttling means between said load chambers and said exhaust means, single pilot valve means operable through said positive load fluid throttling means to throttle fluid flow from said inlet chamber to said supply chamber and also operable through said negative load fluid throttling means to throttle fluid flow from said load chambers to said exhaust means to maintain a constant pressure differential at a preselected constant level across said single pilot valve means and to maintain a constant pressure differential across said first and said second control orifice means, and adjusting control means having means operable through said single pilot valve means to vary the level of said constant pressure differential across one of said first positive load control orifice means and said second negative load control orifice means, without thereby varying the level of said constant pressure differential across the other of the said control orifice means.

2. A control valve assembly as set forth in claim 1 wherein said adjusting control means includes flow orifice means and a flow control means down stream of said flow orifice means.

3. A control valve assembly as set forth in claim 1, wherein said single pilot valve means has control force generating means responsive to pressure differential across said first positive load control orifice means.

4. A control valve assembly as set forth in claim 1 wherein said single pilot valve means has control force generating means responsive to pressure differential across said second negative load control orifice means.

5. A control valve assembly as set forth in claim 1 wherein said single pilot valve means has first control force generating means responsive to pressure differential across said first positive load control orifice means and second negative load control force generating means responsive to pressure differential across said second control orifice means.

6. A control valve assembly as set forth in claim 1 wherein said first valve means has manually operated actuating means.

7. A control valve assembly supplied with pressure fluid by a pump, said control valve assembly comprising a housing having an inlet chamber, a supply chamber, first and second load chambers and exhaust means connected to reservoir means, first valve means for selectively interconnecting said load chambers with said supply chamber and said exhaust means, first positive load control orifice means responsive to movement of said first valve means and operable to meter fluid flow between said supply chamber and said load chambers, second negative load control orifice means responsive to movement of said first valve means and operable to meter fluid flow between said load chambers and said exhaust means, positive load fluid throttling means between said inlet chamber and said supply chamber, negative load fluid throttling means between said load chambers and said exhaust means, single pilot valve means operable through said positive load fluid throttling means to throttle fluid flow from said inlet chamber to said supply chamber and also operable through said negative load fluid throttling means to throttle fluid flow from said load chambers to said exhaust means to maintain a constant pressure differential at a preselected constant level across said single pilot valve means and to maintain a constant pressure differential across said first positive load and said second negative load control orifice means, and adjusting control means having means operable through said single pilot valve means to vary the level of said constant pressure differential across one of said first positive load control orifice means and said second negative load control orifice means without thereby varying said level of said constant pressure differential across the other of said control orifice means.

8. A control valve assembly as set forth in claim 7 wherein said single pilot valve means has first control force generating means responsive to pressure differential across said first positive load control orifice means and second control force generating means responsive to pressure differential across said second negative load control orifice means.

9. A control valve assembly as set forth in claim 7 wherein said first valve means has manually operated actuating means.

* * * * *